US011332880B2

(12) United States Patent
Anand et al.

(10) Patent No.: US 11,332,880 B2
(45) Date of Patent: May 17, 2022

(54) MODIFYING NATURAL FEATHERS FOR USE IN SPORTING GOODS

(71) Applicants: Syam Anand, Ardmore, PA (US); Harish Srinivas, Cheswick, PA (US)

(72) Inventors: Syam Anand, Ardmore, PA (US); Harish Srinivas, Cheswick, PA (US)

(73) Assignee: DURABIRD, Ardmore, PA (US)

( * ) Notice: Subject to any disclaimer, the term of this patent is extended or adjusted under 35 U.S.C. 154(b) by 155 days.

(21) Appl. No.: 16/521,041

(22) Filed: Jul. 24, 2019

(65) Prior Publication Data

US 2019/0345669 A1 Nov. 14, 2019

Related U.S. Application Data

(63) Continuation of application No. 16/279,514, filed on Feb. 19, 2019, now Pat. No. 10,415,180, which is a continuation of application No. 15/758,725, filed as application No. PCT/US2016/050849 on Sep. 9, 2016, now Pat. No. 10,240,284.

(51) Int. Cl.

| | |
|---|---|
| ***D06M 19/00*** | (2006.01) |
| ***F42B 6/06*** | (2006.01) |
| ***D06M 13/127*** | (2006.01) |
| ***D06M 13/123*** | (2006.01) |
| ***A63B 67/19*** | (2016.01) |
| ***A63B 67/187*** | (2016.01) |
| *A63B 102/04* | (2015.01) |

(52) U.S. Cl.

CPC ..... *D06M 19/00* (2013.01); *A63B 67/187* (2016.01); *A63B 67/19* (2016.01); *D06M 13/123* (2013.01); *D06M 13/127* (2013.01); *F42B 6/06* (2013.01); *A63B 2102/04* (2015.10); *A63B 2209/02* (2013.01); *D06M 2400/01* (2013.01)

(58) Field of Classification Search

CPC .. D06M 19/00; D06M 13/123; D06M 13/127; D06M 2400/01; A63B 67/187; A63B 67/19; A63B 2102/04; A63B 2209/02; F42B 6/06

See application file for complete search history.

(56) References Cited

U.S. PATENT DOCUMENTS

| | | | | |
|---|---|---|---|---|
| 2006/0228161 | A1 | 12/2006 | Hoadley | |
| 2007/0287018 | A1 | 12/2007 | Tutin | |
| 2012/0052993 | A1 | 3/2012 | Li et al. | |
| 2012/0157248 | A1* | 6/2012 | Dai | A63B 67/19 473/580 |

FOREIGN PATENT DOCUMENTS

| | | | |
|---|---|---|---|
| CN | 102974084 | | 3/2013 |
| CN | 103485186 | | 1/2014 |
| GB | 1441110 | A | 6/1976 |
| JP | 6359484 | A | 3/1988 |
| JP | 5595870 | | 9/2014 |
| JP | 6305948 | | 4/2018 |
| JP | 6321078 | A | 5/2018 |

* cited by examiner

*Primary Examiner* — Amina S Khan

(74) *Attorney, Agent, or Firm* — Mainline Intellectual Property; Syam Anand

(57) ABSTRACT

Methods, apparatus and kits for modifying natural feathers that are used in sporting goods that result in long lasting feathers with increased mechanical stability, reliability and durability as well as improved flight consistency are disclosed. Some of the sporting goods that use natural feathers are badminton shuttlecocks, arrow fletchings, and darts. The disclosed methods consist of controlled treatment of feather shuttlecocks with crosslinking agents to crosslink the keratin protein present on the natural feathers of the shuttlecock.

12 Claims, 4 Drawing Sheets

A

B

MODIFYING NATURAL FEATHERS FOR USE IN SPORTING GOODS

PRIORITY PARAGRAPH

This application claims priority to the U.S. continuation application Ser. No. 16/279,514, filed on Feb. 19, 2019, now U.S. Pat. No. 10,415,180, which claims priority to the U.S. National Stage application Ser. No. 15/758,725, filed on Mar. 8, 2018, now U.S. Pat. No. 10,240,284, which claims priority to the PCT application PCT/US2016/050849 filed on Sep. 9, 2016, which claims priority to the provisional application No. 62/216,101, filed on Sep. 9, 2015, titled "Modifying natural feathers for use in sporting goods" and are incorporated herein in their entirety by reference.

BACKGROUND

Disclosed herein are methods, apparatus and kits to modify natural feathers that are used in sporting goods. Some of the sporting goods that use natural feathers are shuttlecocks, arrow fletchings, and dart. The methods disclosed herein impart structural stability and durability to natural feathers, thereby improving the life span of the sporting goods.

In 160 countries, more than 14 million people play shuttle badminton competitively. In the USA, more than a million players regularly play shuttle badminton. Natural feather shuttlecocks, that are the projectiles used to play the game, are delicate and easily become deformed and also break, affecting the progress of the game. The use of several natural feather shuttlecocks even to finish just one game also makes the sport very expensive. As a result, cheaper plastic shuttlecocks are used in place of natural feather shuttlecocks. However, since they are not equivalent to natural feather shuttlecocks in feel and flight characteristics, they are not used in professional tournaments.

During games, shuttlecocks with broken or deformed feathers, or those that have lost their structural integrity display altered flight characteristics and thereby affect the progress of the games. Even in the event of obvious deformation or damage to feather shuttlecocks in the middle of a play, the rules of the game demand that play continue until one player or side scores a point. The feather shuttlecocks currently used in badminton have limited structural stability, flight consistency and durability. Therefore, there is a great need for natural feather shuttlecocks that are long lasting and have higher structural stability, mechanical stability, increased durability and reliability as well as consistent flight characteristics.

In archery and bow hunting, the speed and accuracy for an arrow is provided by fletching the arrow. Fletching is typically defined as the feather-like appendages on an arrow or the arrangement of such appendages. Fletching typically includes three or four feathers or vanes which may be mounted helically along the arrow shaft to promote spinning of the arrow during flight. Feathers are very light and, when used for fletching, help provide greater speed to an arrow than do the heavier plastic fletching. Such feather fletching equipped arrows, due to their lighter weight, are faster at greater distances and thereby more accurate farther down range. Feathers, however, do have some disadvantages. Feathers are very delicate and damage easily due to rough treatment. When damaged, feathers cannot be repaired, but rather must be completely replaced. Such replacement can be expensive, difficult and time consuming. Therefore, there is a great need for natural feather fletching that are long lasting and have higher structural stability, and mechanical stability.

SUMMARY

Disclosed herein are methods, apparatus and kits to modify natural feathers that are used in sporting goods. Some of the sporting goods that use natural feathers are shuttlecocks, arrow fletchings, and dart. The methods disclosed herein impart structural stability and durability to natural feathers, thereby improving the life span of the sporting goods.

In one embodiment, a method for modifying a natural feather shuttlecock includes contacting the natural feather shuttlecock with at least one or more crosslinking agents, wherein the one or more crosslinking agents crosslink the feathers of the shuttlecock. The crosslinking agents may be homobifunctional crosslinking agent, a heterobifunctional crosslinking agent, a trifunctional crosslinking agent, and combinations thereof. The crosslinking agents may crosslink one or more reactive groups present on the feathers of the shuttlecock, wherein the one or more reactive groups are selected from amine, amide, sulfhydryl, carbonyl, aldehyde, hydroxyl, carboxyl, and combinations thereof.

Also disclosed herein are modified natural feather shuttlecocks. In some embodiments, a modified natural feather shuttlecock is formed by the process comprising contacting the natural feather shuttlecock with at least one or more crosslinking agents, wherein the one or more crosslinking agents crosslink the feathers of the shuttlecock. Further, contacting the natural feather shuttlecock with crosslinking agents is performed under humid conditions in a closed reaction vessel. In addition, contacting comprises exposing the natural feather shuttlecock to vapors of one or more crosslinking agents or to a solution of one or more crosslinking agents. The crosslinking agents are selected from the group consisting of a homobifunctional crosslinking agent, a heterobifunctional crosslinking agent, a trifunctional crosslinking agent, and combinations thereof.

In another embodiment, a natural feather shuttlecock treated with crosslinking agents is further modified by applying additional reinforcements, such as threads, filaments, patches, injections or combinations thereof along individual feather shafts.

In an additional embodiment, an apparatus for manufacturing long lasting feather shuttlecocks is also disclosed. The apparatus includes crosslinking agents, elements for introducing, holding and removing shuttlecocks and crosslinking agents, and reaction chamber to perform the crosslinking treatment under humid conditions, in any chemical or physical form, for fixed amounts of time. The apparatus helps in the production of long lasting shuttlecocks.

In a further embodiment, a kit for modifying natural feather shuttlecock is also disclosed. The kit includes one or more crosslinking agents in a solution form, and a container for spraying the one or more crosslinking agents. The kit may further include an ultraviolet light source, one or more humidity chambers, and instructions for treating the shuttlecocks with crosslinking agents.

In additional embodiment, a method for modifying an arrow fletching derived from natural feather includes contacting the natural feather with at least one or more crosslinking agents, wherein the one or more crosslinking agents crosslink the feathers. The crosslinking agents may be homobifunctional crosslinking agent, a heterobifunctional crosslinking agent, a trifunctional crosslinking agent, and combinations thereof. The crosslinking agents may crosslink one or more reactive groups present on the feathers, wherein the one or more reactive groups are selected from amine, amide, sulfhydryl, carbonyl, aldehyde, hydroxyl, carboxyl, and combinations thereof. The modified natural feathers are then assembled as arrow fletching.

In a further embodiment, a kit for modifying an arrow fletching derived from natural feather. The kit includes one or more crosslinking agents in a solution form, and a container for spraying the one or more crosslinking agents. The kit may further include an ultraviolet light source, one or more humidity chambers, and instructions for treating the natural feathers with crosslinking agents.

DETAILED DESCRIPTION

During badminton games using natural feather shuttlecocks, the constant impact from rackets affect the integrity of feathers in an undesirable manner. A loss of the interlocking complex arrangement of the constituent parts of the vanes distort the shuttlecocks and affect their flight characteristics. More often, this leads to noticeable and inconvenient slowing of the feathered shuttlecocks while they are in play. As the interlocking arrangement of the vanes comes apart, the natural feather shuttlecocks become more and more unpredictable and unreliable. This necessitates their replacement. In addition, breakage of feather shafts also occur frequently which make the shuttlecocks unfit for play. The methods, apparatus and kits disclosed here increases the structural stability, durability, consistency and reliability of the natural feather shuttlecocks by maintaining the integrity of the vanes for significantly longer times, when compared to untreated natural feather shuttlecocks. They also impart higher strength to the feather shafts. This is probably achieved by the additional crosslinks that arise between the substructures of the vane as well as constituents of the shaft, as a result of the treatments disclosed herein, and provide more efficient interlocking and strength.

Figure 2:
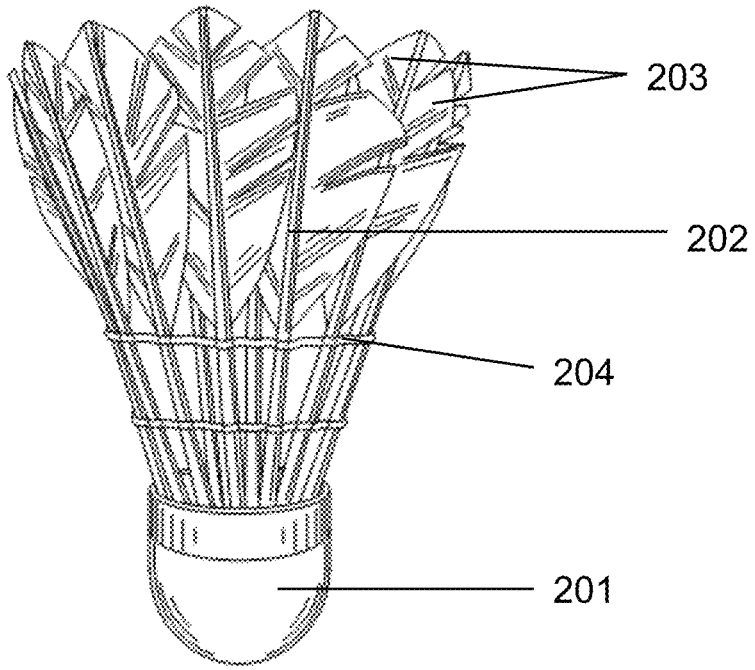
FIG. 2 depicts an illustrative example of a natural feather shuttlecock not treated (A) and treated (B) with crosslinking agents. The untreated natural feather shuttlecock displayed frizzled or deformed vanes after certain duration of play. The natural feather shuttlecock treated with a crosslinking agent displayed intact vanes after certain duration of play.
Figure 2:
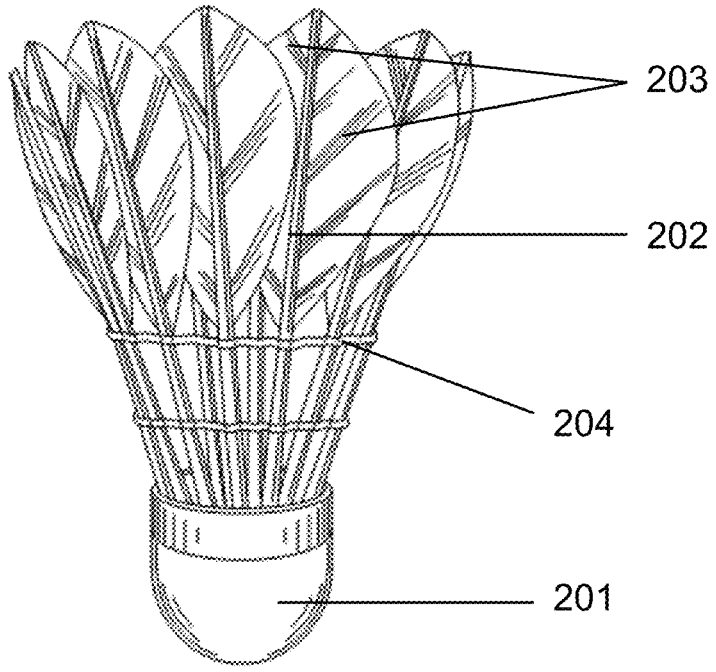

A typical natural feather shuttlecock (FIG. 2) consists of a hemispherical bottom portion made of leather-covered cork 201, and a top portion made of feathers. The feathers are usually from birds, such as geese, ducks, waterfowl, or the like, and the ends of the stems of the feathers are embedded into the hemispherical portion. Each natural feather consists of a central, stiff shaft 202 with the softer vanes 203 on each side. Additionally, one or more sets of threads 204 are used to tie the bottom portions of the shafts of feathers together to provide more reinforcement and integrity to the shuttlecock.

The vane-harboring portions of 16 or so such feathers is placed in an overlapping manner on the cork to form a skirt and forms the top portion of the shuttlecock. The vanes of these natural feathers are made of a series of parallel branches called barbs. Extending from the barbs are a series of short branchlets called barbules. Tiny hooklets arise from the barbules, and tie the barbules and ultimately the barbs, together. This branching arrangement creates a strong yet light structure for natural feather shuttlecocks. The flight characteristics of natural feather shuttlecocks depend on the integrity of this complex branching and interlocking structure.

Figure 3:
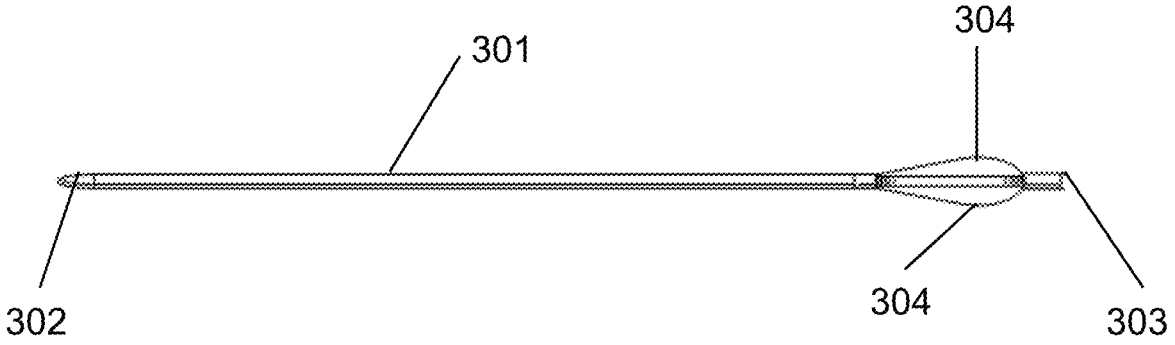
FIG. 3 depicts an arrow fletched with natural feathers according to an embodiment.

Arrows (FIG. 3) generally include an arrow shaft 301 having an arrowhead 302 mounted on one end of the shaft and a nock 303 on the opposite end of the arrow shaft. Arrows also typically include fletching 304 mounted near the nock end of the arrow shaft. The nock 303 is also generally fixed in place relative to the arrow fletching 304. Conventionally, the plurality of feathers or vanes is adhered or fletched to the surface of the arrow shaft using epoxy, glue, or some other suitable adhesive. The feathers or vanes are typically evenly spaced around the circumference of the arrow shaft. For example, where three feathers are employed, each of the three feathers is approximately 120° apart from adjacent feathers. Further, the feathers are fletched (or mounted) with a slight turn so that during the flight the arrow rotates. The feathers are usually from birds, such as geese, ducks, waterfowl, turkey, or the like.

As used herein, "alkylene" refers to a bivalent alkyl moiety having the general formula $—(CH_2)_n—$, where n is from about 1 to about 50, preferably about 1 to about 20, more preferably about 1 to about 16, with about 1 to about 10 being even more preferred. By bivalent, it is meant that the group has two open sites each of which bonds to another group. Non-limiting examples include methylene, ethylene, trimethylene, pentamethylene, and hexamethylene. Alkylene groups can be optionally substituted with linear or branched alkyl groups.

As used herein, "alkenylene" refers to a divalent alkenyl moiety, meaning the alkenyl moiety is attached to the rest of the molecule at two positions. The term "alkenyl" means a straight or branched alkyl group having one or more double carbon-carbon bonds and 2-20 carbon atoms, including, but not limited to, ethenyl, 1-propenyl, 2-propenyl, 2-methyl-1-propenyl, 1-butenyl, 2-butenyl, and the like. In some embodiments, the alkenyl chain is from 2 to 10 carbon atoms in length, from 2 to 8 carbon atoms in length, from 2 to 6 carbon atoms in length, or from 2 to 4 carbon atoms in length.

As used herein, "alkynylene" refers to a divalent alkynyl moiety, meaning the alkynyl moiety is attached to the rest of the molecule at two positions. The term "alkynyl" means a straight or branched alkyl group having one or more triple carbon-carbon bonds and 2-20 carbon atoms, including, but not limited to, acetylene, 1-propylene, 2-propylene, and the like. In some embodiments, the alkynyl chain is 2 to 10 carbon atoms in length, from 2 to 8 carbon atoms in length, from 2 to 6 carbon atoms in length, or from 2 to 4 carbon atoms in length.

As used herein, the term "arylene" means an aryl linking group, i.e., an aryl group that links one group to another group in a molecule.

"Substituted" refers to when one or more hydrogen atoms attached to carbon of the hydrocarbon chain (alkylene, alkenylene, alkynylene) is replaced by another group, such as halogen, aryl, substituted aryl, cycloalkyl, substituted cycloalkyl, and combinations thereof.

The term "substituted arylene" refers to arylene as just described in which one or more hydrogen atoms attached to any carbon atoms is replaced by one or more functional groups such as alkyl, substituted alkyl, cycloalkyl, substituted cycloalkyl, heterocycloalkyl, substituted heterocycloalkyl, halogen, halogenated alkyl (e.g., CF 3), hydroxy, amino, phosphino, alkoxy, amino, thio and both saturated and unsaturated cyclic hydrocarbons which are fused to the aromatic ring(s), linked covalently or linked to a common group such as a methylene or ethylene moiety. The linking group may also be a carbonyl such as in cyclohexyl phenyl ketone.

Modifying Natural Feather Shuttlecocks

Disclosed herein are methods, apparatus and kits for modifying badminton natural feather shuttlecocks. Methods disclosed herein may increase the structural stability, durability, consistency, and reliability of the natural feather shuttlecocks, and result in long lasting shuttlecocks. Further, the modified natural feather shuttlecocks may display increased skirt structural strength and resist deformation of the skirt upon impact with a racket.

In one embodiment, a method for modifying natural feather shuttlecock involves contacting the natural feather shuttlecock with at least one or more crosslinking agents, wherein the one or more crosslinking agents crosslink the feathers of the shuttlecock. The natural feathers are usually made of keratin and may have one or more reactive groups, such as amine, amide, sulfhydryl, carbonyl, aldehyde, hydroxyl, carboxyl, and the like. The crosslinking agents disclosed herein may crosslink the reactive groups present on the feathers. The crosslinks may occur between one or more reactive groups present on the same feather. In some embodiments, the crosslinks may occur between one or more reactive groups present on two different feathers, or between two adjacent feathers. Such crosslinks may impart structural stability to the natural feather shuttlecocks, without appreciable change in their flight characteristics, when compared to unmodified natural feather shuttlecocks.

Non-limiting examples of crosslinking agents that may be used to modify feathers of the shuttlecock are homobifunctional crosslinking agents, heterobifunctional crosslinking agents, trifunctional crosslinking agents, multifunctional crosslinking agents, and combinations thereof. A homobifunctional crosslinking agent has a spacer arm with same reactive groups at both the ends. A heterobifunctional crosslinking agent has a spacer arm with different reactive groups at the two ends. A trifunctional crosslinking agent has three short spacers arms linked to a central atom, such as nitrogen, and each spacer arm ending in a reactive group. The crosslinking agents disclosed herein may crosslink amino-amino groups, amino-sulfhydryl groups, sulfhydryl-sulfhydryl groups, amino-carboxyl groups, and the like. Any crosslinking agent known in the art that crosslink proteins may be used. In addition, the crosslinking agents may be a chemical crosslinking agent or a UV-inducible crosslinking agent.

Non-limiting examples of crosslinking agents that may be used to modify the feathers of the shuttlecock are NHS (N-hydroxysuccinimide); sulfo-NHS (N-hydroxysulfosuccinimide); EDC (1-Ethyl-3-[3-dimethylaminopropyl]); carbodiimide hydrochloride; SMCC (succinimidyl 4-(N-maleimidomethyl)cyclohexane-1-carboxylate); sulfo-SMCC; DSS (disuccinimidyl suberate); DSG (disuccinimidyl glutarate); DFDNB (1,5-difluoro-2,4-dinitrobenzene); BS3 (bis(sulfosuccinimidyl)suberate); TSAT (tris-(succinimidyl) aminotriacetate); BS(PEG)5 (PEGylated bis(sulfosuccinimidyl)suberate); BS(PEG)9 (PEGylated bis(sulfosuccinimidyl)-suberate); DSP (dithiobis(succinimidyl propionate)); DTSSP (3,3'-dithiobis(sulfosuccinimidyl propionate)); DST (disuccinimidyl tartrate); BSOCOES (bis(2-(succinimidooxycarbonyloxy)-ethyl)sulfone); EGS (ethylene glycol bis(succinimidyl succinate)); DMA (dimethyl adipimidate); DMP (dimethyl pimelimidate); DMS (dimethyl suberimidate); DTBP (Wang and Richard's Reagent); BM(PEG)2 (1,8-bismaleimido-diethyleneglycol); BM(PEG)3 (1,11-bismaleimido-triethyleneglycol); BMB (1,4-bismaleimidobutane); DTME (dithiobismaleimidoethane); BMH (bismaleimidohexane); BMOE (bismaleimidoethane); TMEA (tris(2-maleimidoethyl)amine); SPDP (succinimidyl 3-(2-pyridyldithio)propionate); SMCC (Succinimidyl trans-4-(maleimidylmethyl)cyclohexane-1-Carboxylate); SIA (succinimidyl iodoacetate); SBAP (succinimidyl 3-(bromoacetamido)propionate); STAB (succinimidyl (4-iodoacetyl)-aminobenzoate); Sulfo-SIAB (sulfosuccinimidyl (4-iodoacetyl) aminobenzoate); AMAS (N-α-maleimidoacet-oxysuccinimide ester); BMPS (N-β-maleimidopropyl-oxysuccinimide ester); GMBS (N-γ-maleimidobutyryl-oxysuccinimide ester); Sulfo-GMBS (N-γ-maleimidobutyryl-oxysulfosuccinimide ester); MBS (m-maleimidobenzoyl-N-hydroxysuccinimide ester); Sulfo-MBS (m-maleimidobenzoyl-N-hydroxysulfosuccinimide ester); SMCC (succinimidyl 4-(N-maleimidomethyl)cyclohexane-1-carboxylate); Sulfo-SMCC (sulfosuccinimidyl 4-(N-maleimidomethyl)cyclohexane-1-carboxylate); EMCS (N-ε-malemidocaproyl-oxysuccinimide ester); Sulfo-EMCS (N-ε-maleimidocaproyl-oxysulfosuccinimide ester); SMPB (succinimidyl 4-(p-maleimidophenyl)butyrate); Sulfo-SMPB (sulfosuccinimidyl 4-(N-maleimidophenyl)-butyrate); SMPH (Succinimidyl 6-((beta-maleimidopropionamido)-hexanoate)); LC-SMCC (succinimidyl 4-(N-maleimidomethyl) cyclohexane-1-carboxy-(6-amidocaproate)); Sulfo-KMUS (N-κ-maleimidoundecanoyl-oxysulfosuccinimide ester); SPDP (succinimidyl 3-(2-pyridyldithio)propionate); LC-SPDP (succinimidyl 6-(3(2-pyridyldithio)propionamido) hexanoate); LC-SPDP (succinimidyl 6-(3(2-pyridyldithio)propionamido)hexanoate); Sulfo-LC-SPDP (sulfosuccinimidyl 6-(3'-(2-pyridyldithio)propionamido)hexanoate); SMPT (4-succinimidyloxycarbonyl-alpha-methyl-α(2-pyridyldithio)toluene); PEG4-SPDP (PEGylated, long-chain SPDP crosslinker); PEG12-SPDP (PEGylated, long-chain SPDP crosslinker); SM(PEG)2 (PEGylated SMCC crosslinker); SM(PEG)4 (PEGylated SMCC crosslinker); SM(PEG)6 (PEGylated, long-chain SMCC crosslinker); SM(PEG)8 (PEGylated, long-chain SMCC crosslinker); SM(PEG)12 (PEGylated, long-chain SMCC crosslinker); SM(PEG)24 (PEGylated, long-chain SMCC crosslinker); BMPH (N-β-maleimidopropionic acid hydrazide); EMCH (N-ε-maleimidocaproic acid hydrazide); MPBH (4-(4-N-maleimidophenyl)butyric acid hydrazide); KMUH (N-κ-maleimidoundecanoic acid hydrazide); PDPH (3-(2-pyridyldithio)-propionyl hydrazide); ATFB-SE (4-Azido-2,3,5,6-Tetrafluorobenzoic Acid, Succinimidyl Ester); ANB-NOS (N-5-azido-2-nitrobenzoyloxysuccinimide); SDA (NHS-Diazirine) (succinimidyl 4,4'-azipentanoate); LC-SDA (NHS-LC-Diazirine) (succinimidyl 6-(4,4'-azipentanamido)hexanoate); SDAD (NHS-SS-Diazirine) (succinimidyl 2-((4,4'-azipentanamido)ethyl)-1,3'-dithiopropionate); Sulfo-SDA (Sulfo-NHS-Diazirine) (sulfosuccinimidyl 4,4'-azipentanoate); Sulfo-LC-SDA (Sulfo-NHS-LC-Diazirine) (sulfosuccinimidyl 6-(4,4'-azipentanamido)hexanoate); Sulfo-SDAD (Sulfo-NHS-SS-Diazirine) (sulfosuccinimidyl 2-((4,4'-azipentanamido)ethyl)-1,3'-dithiopropionate); SPB (succinimidyl-[4-(psoralen-8-yloxy)]-butyrate); Sulfo-SANPAH (sulfosuccinimidyl 6-(4'-azido-2'-nitrophenylamino)hexanoate); DCC (dicyclohexylcarbodiimide); EDC (1-ethyl-3-(3-dimethylaminopropyl)carbodiimide hydrochloride); glutaraldehyde, formaldehyde, paraformaldehyde, succinaldehyde, glyoxal, methylene glycol, and any combination thereof. In some embodiments, glutaraldehyde acetals, 1,4-pyran, and 2-alkoxy-3,4-dihydro-2H-pyrans, such as 2-ethoxy-3,4-dihydro-2H-pyran may be used in place of glutaraldehyde.

In some embodiments, the crosslinking agents may have spacer arms between the reactive end groups. The length of the spacer arm may determine the type of the crosslinks on the natural feather shuttlecocks. For example, crosslinking agents with shorter spacer arm may result in forming crosslinks between two reactive groups that are present on adjacent barbules or hooklets of the same feather. Traditional crosslinking agents have spacer arms that contain hydrocarbon chains or polyethylene glycol (PEG) chains. In addition, the molecular composition of a crosslinking agent's spacer arm may affect solubility. Hydrocarbon chains are not water soluble and typically require an organic solvent such as DMSO or DMF for suspension.

In some embodiments, the crosslinking agents used for modifying natural feather shuttlecocks may be of formula $X_1$—R—$X_2$ wherein is $X_1$ and $X_2$ are independently, imide, imidoester, succinimide, succinimidylsuccinate, sulfosuccinimide, oxysuccinimide, oxysulfosuccinimide, sulfosuccinimidylsuccinate, succinimidyloxyl, succinimidyloxycarbonyl, succinimidyloxycarbonyloxyl, maleimide, halogen, pyridylthio, maleimidopropionamido, hydrazide, azidofluorobenzoic acid, fluorobenzoic acid, 5-azido-2nitrobenzoyl Y-succinimide, diazirine, nitrophenylazide, cyclohexylimide. In some embodiments, R is substituted or unsubstituted alkylene, substituted or unsubstituted alkenylene, substituted or unsubstituted alkynylene, substituted or unsubstituted arylene, substituted or unsubstituted cyclic alkylene, substituted or unsubstituted cyclic alkenylene, substituted or unsubstituted cyclic alkynylene, and substituted or unsubstituted polyethylene glycols. Substituent groups may be, but not limited to, thiol, nitro, amido, ester, oxy, sulfones, oxycarbonyl groups.

In some embodiments, the crosslinking agents used for modifying natural feather shuttlecocks may be photoreactive crosslinking agents, such as UV-crosslinking agents. Photoreactive agents are chemically inert compounds that become reactive when exposed to ultraviolet or visible light. Photoreactive groups that may be incorporated in the crosslinking agent include aryl azides, azido-methyl-coumarins, benzophenones, anthraquinones, certain diazo compounds, diazirines, and psoralen derivatives.

In some embodiments, the crosslinking agents used for modifying natural feather shuttlecocks may be silicone crosslinking agents of the formula:

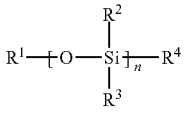

wherein, each $R^1$ to $R^4$, is independently, alkyl, alkenyl, alkynyl, aryl, cycloalkyl, substituted alkyl, substituted alkenyl, substituted alkynyl, substituted aryl, substituted cycloalkyl, and n is an integer from 1 to 20.

In some embodiments, the natural feather shuttlecocks may be contacted with one or more crosslinking agents by methods, such as dipping, or soaking the shuttlecock in a solution of crosslinking agent(s), coating or applying a solution of crosslinking agent(s) to the shuttlecock or a portion of the shuttlecock, spraying a solution of crosslinking agent(s) on the shuttlecock or a portion of the shuttlecock, and the like.

In some embodiments, the natural feather shuttlecocks may be contacted with vapors of crosslinking agent(s), preferably in a closed chamber or a reaction vessel. In some embodiments, the natural feather shuttlecocks may be incubated in a closed chamber saturated with vapors of crosslinking agent(s).

The natural feather shuttlecocks may be contacted with one or more crosslinking agents for about 2 minutes to 20 hours, about 2 minutes to 15 hours, about 2 minutes to 10 hours, about 2 minutes to 5 hours, about 2 minutes to 2 hours, about 2 minutes to 1 hour, about 2 minutes to 45 minutes, about 2 minutes to 30 minutes, about 2 minutes to 15 minutes, about 2 minutes to 10 minutes, or about 2 minutes to 5 minutes. Specific examples include about 2 minutes, about 5 minutes, about 10 minutes, about 15 minutes, about 30 minutes, about 45 minutes, about 60 minutes, about 2 hours, about 5 hours, about 10 hours, about 15 hours, about 20 hours, and ranges between any two of these values.

The duration of the time period for contacting may depend on the concentration of the crosslinking agents used. In some embodiments, the one or more crosslinking agents are used in a concentration sufficient to form a crosslink within hooklets, hooks, barbs or barbules of the same feather or within the shafts of the same feather or between two adjacent hooklets, hooks, barbs, barbules of two adjacent feathers. The concentration of the crosslinking agent solution used in the methods disclosed herein may be from about 1% to about 100%, about 1% to about 90%, about 1% to about 80%, about 1% to about 70%, about 1% to about 60%, about 1% to about 50%, about 1% to about 40%, about 1% to about 30%, about 1% to about 20%, about 1% to about 10%, about 1% to about 5%, or about 1% to about 2%. The percentages disclosed herein may be weight-by-volume (w/v) percentages for solid crosslinking agents. For liquid crosslinking agents, it may be volume-by-volume (v/v) percentages.

Some non-limiting embodiments of the method described herein include-exposing the natural feather shuttlecocks to vapors of 36% formaldehyde solution in a closed chamber; exposing the natural feather shuttlecocks to vapors of 18% formaldehyde solution in a closed chamber; exposing the natural feather shuttlecocks to vapors of 10% formaldehyde solution in a closed chamber; exposing the natural feather shuttlecocks to vapors of 50% gluteraldehyde solution in a closed chamber; exposing the natural feather shuttlecocks to vapors of 25% gluteraldehyde solution in a closed chamber; exposing the natural feather shuttlecocks to vapors of 10% gluteraldehyde solution in a closed chamber; spraying a 10% formaldehyde solution on the natural feather shuttlecocks; spraying a 10% formaldehyde solution on the natural feather shuttlecocks; spraying a 50% gluteraldehyde solution on the natural feather shuttlecocks; spraying a 25% gluteraldehyde solution on the natural feather shuttlecocks; spraying a 10% gluteraldehyde solution on the natural feather shuttlecocks; spraying a 4% paraformaldehyde solution on the natural feather shuttlecocks; coating a 10% formaldehyde solution on the natural feather shuttlecocks; and coating a 10% disuccinimidyl suberate solution on the natural feather shuttlecocks.

In some embodiments, chemicals such as methanol, urea, melamine, organic colloids (e.g., methyl cellulose, graft polymers of vinyl acetate and ethylene glycol formaldehyde polyacetal), water insoluble acetals of polyvinyl alcohol, and other polymeric materials such as low molecular weight vinyl polymers containing acetal, acetate, hydroxyl, and optionally, formal, propional or butyral groups may be added to formaldehyde or glutaraldehyde solution to prevent formation of formaldehyde polymers or glutaraldehyde polymers in the solution, and to increase its availability for crosslinking.

In some embodiments, the natural feather shuttlecocks may be contacted with crosslinking agents under humid conditions in a closed reaction vessel or a chamber. Presence of moisture may prevent the natural feathers from becoming dry and brittle. The humidity in the chamber may be present from about 2% to about 90%, about 2% to about 70%, about 2% to about 50%, or about 2% to about 20%.

In some embodiments, the natural feather shuttlecocks may be pretreated or exposed to humidifying conditions before contacting the crosslinking agents. In some embodiments, the natural feather shuttlecocks may also be pretreated with moisture, wetting agents, lubricants (petroleum jelly, glycerin, paraffin wax, polypropylene glycol etc.), and the like before contacting the crosslinking agents.

In some embodiments, the natural feather shuttlecocks may be contacted with the crosslinking agents in the presence of a buffer, to maintain adequate pH conditions for crosslinking. The buffers that may be used in the methods described herein are, phosphate buffers, acetate buffers, citrate buffers, borate buffers, Tris buffers, HEPES buffers, PIPES buffers, MOPS buffers, carbonate buffers, bicarbonate buffers, or any buffers known in the art. These buffering agents may be used to maintain a pH range suitable for crosslinking agents to react with the functional groups present on the natural feathers. Preferred pH range may be from pH 2 to about pH 10, from pH 2 to about pH 9, from pH 2 to about pH 8, from pH 2 to about pH 7, and ranges between any two of these values.

In some embodiments, the natural feather shuttlecocks may be pretreated with buffers before contacting crosslinking agents. For example, a pH buffering agent described herein may be sprayed on the natural feather shuttlecocks before contacting them with the crosslinking agents. In a non-limiting embodiment, the natural feather shuttlecock may be pretreated with phosphate buffered saline from 2 minutes to 20 hours before contacting the one or more crosslinking agents. In other embodiments, the crosslinking agents may be dissolved in a buffer solution before they contact the natural feather shuttlecocks.

In some embodiments, the natural feather shuttlecocks are further treated with an antioxidant prior to crosslinking or after crosslinking step. Without wishing to be bound by theory, the antioxidants may prevent oxidation of amino acids present on the keratin fibers of the natural feathers, and further improve the shelf life of the natural feather shuttlecocks. Non-limiting embodiments of antioxidants that may be used to treated natural feather shuttlecocks are diethylhexyl syringylidene maionate, Vitamin E, diisopropyl vanillidene maionate, tetrahydrocurcumenoids, tocopherol, carotenoids, and anthocyanidins. In some embodiments, non-volatile antioxidants may be used. Examples of such antioxidants include n-propyl 3,4,5-trihydroxybenzoate, 1,2-dihydroxy-4-tert-butylbenzene, 2-isopropyl-5-methylphenol, 3-tert-butyl-4-hydroxyanisole (BHA), butylated hydroxytoluene (BHT), hydroquinone monomethyl ether, 4-isopropoxyphenol, and 4-(1-methylpropyl)phenol. In one embodiment, the volatile antioxidant is a phenol functional antioxidant.

In some embodiments, the natural feathers may be treated by the crosslinking agents and the methods disclosed herein and then assembled to form a shuttlecock.

In some embodiments, following the treatment of natural feather shuttlecocks treated with crosslinkers, the reaction may be quenched or terminated with chemicals such as glycine. In other embodiments, the treated shuttlecocks may be placed in a chamber with air flow or suction, at room temperature, to remove unreacted crosslinking agents.

Figure 4:
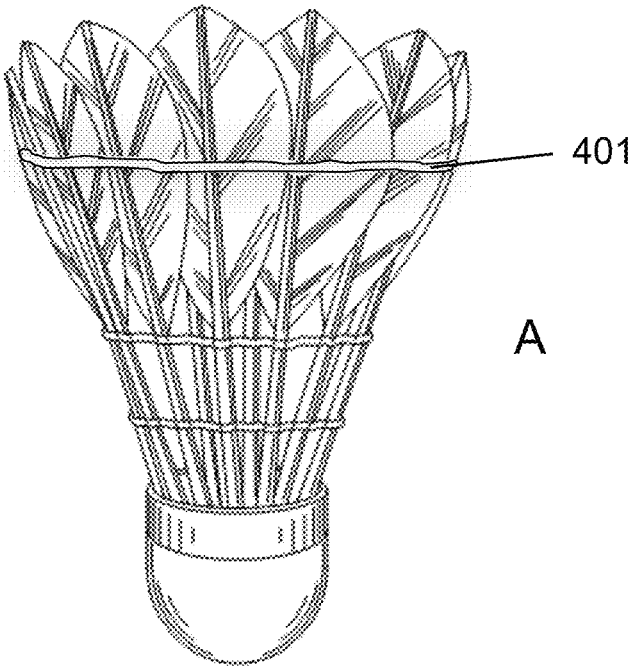
FIG. 4 depicts an illustrative example of a natural feather shuttlecock (A) reinforced by a thread 401 across the shafts in the skirt region of the shuttlecock and (B) reinforced by a filament 402 along the individual shafts on the skirt region of the shuttlecock.
Figure 4:
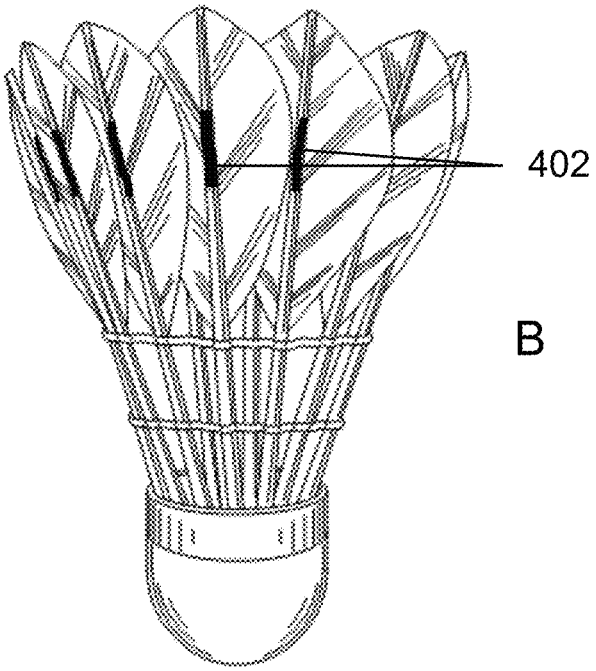

In some embodiments, the natural feather shuttlecocks treated with crosslinking agents are further modified with reinforcements, such as threads, filaments, patches, injections or combinations thereof along individual feather shafts. For example, as shown in FIG. 4A, a thread 401 may be used to tie the shafts of the feathers in the skirt region. In other embodiments, as shown in FIG. 4B a lightweight polymeric filament 402 may be applied along the shaft. Such reinforcements may not increase the weight of the shuttlecock appreciably. Filaments made of lightweight alloys may also be used in place of polymeric filaments. Filaments may be applied along the outer side of the shuttlecock as shown in FIG. 4B or along the inner side of the shuttlecock or both.

Also disclosed herein is an apparatus for modifying natural feather shuttlecock. The apparatus may include a closed reaction vessel having an inlet configured to allow a crosslinking agent in vapor form or liquid form to enter the reaction vessel. The crosslinking agent may have reactivity to amine, sulfhydryl, carbonyl, aldehyde, hydroxyl, or carboxyl groups present on the feathers. Further, the reaction vessel may have an outlet configured to allow the crosslinking agent to exit the reaction vessel. The apparatus may further include mechanical elements for introducing, holding and removal of shuttlecocks. The apparatus may also include a thermoelectric couple, a pressure gauge, a temperature controller, a cooling system, a mechanical stirrer, or any combination thereof. The reaction vessel of apparatus may be configured to maintain humidity during the reaction process. The reaction vessel may also be configured to maintain the crosslinking agent in vapor state during the course of the reaction.

Also disclosed herein are kits for modifying the natural feather shuttlecocks. The kit includes one or more crosslinking agents in a solution form, and a container for spraying or applying the one or more crosslinking agents. The kit may further include an ultraviolet light source, one or more humidity chambers, and instructions for treating the shuttlecocks with crosslinking agents.

Modifying Arrow Fletchings

Disclosed herein are methods, apparatus and kits for modifying natural feathers that may be used as arrow fletchings. Methods disclosed herein may increase the structural stability, durability, consistency, and reliability of the natural feather, and result in long lasting arrow.

In one embodiment, a method for modifying an arrow fletching derived from natural feather involves contacting the natural feather with at least one or more crosslinking agents, wherein the one or more crosslinking agents crosslink the feathers. The natural feathers are usually made of keratin and may have one or more reactive groups, such as amine, amide, sulfhydryl, carbonyl, aldehyde, hydroxyl, carboxyl, and the like. The crosslinking agents disclosed herein may crosslink the reactive groups. The crosslinks may occur between one or more reactive groups present on the same feather. The treated feathers may be then assembled as arrow fletchings. Such crosslinks may impart structural stability to the natural feather fletchings, when compared to unmodified natural feather fletchings.

Non-limiting examples of crosslinking agents that may be used are homobifunctional crosslinking agents, heterobifunctional crosslinking agents, trifunctional crosslinking agents, multifunctional crosslinking agents, and combinations thereof. A homobifunctional crosslinking agent has a spacer arm with same reactive groups at both the ends. A heterobifunctional crosslinking agent has a spacer arm with different reactive groups at the two ends. A trifunctional crosslinking agent has three short spacers arms linked to a central atom, such as nitrogen, and each spacer arm ending in a reactive group. The crosslinking agents disclosed herein may crosslink amino-amino groups, amino-sulfhydryl groups, sulfhydryl-sulfhydryl groups, amino-carboxyl groups, and the like. Any crosslinking agent known in the art that crosslink proteins may be used. In addition, the crosslinking agents may be a chemical crosslinking agent or a UV-inducible crosslinking agent.

Non-limiting examples of crosslinking agents that may be used to modify arrow fletchings are NHS (N-hydroxysuccinimide); sulfo-NHS (N-hydroxysulfosuccinimide); EDC (1-Ethyl-3-[3-dimethylaminopropyl]); carbodiimide hydrochloride; SMCC (succinimidyl 4-(N-maleimidomethyl)cyclohexane-1-carboxylate); sulfo-SMCC; DSS (disuccinimidyl suberate); DSG (disuccinimidyl glutarate); DFDNB (1,5-difluoro-2,4-dinitrobenzene); BS3 (bis(sulfosuccinimidyl)suberate); TSAT (tris-(succinimidyl)aminotriacetate); BS(PEG)5 (PEGylated bis(sulfosuccinimidyl)suberate); BS(PEG)9 (PEGylated bis(sulfosuccinimidyl)-suberate); DSP (dithiobis(succinimidyl propionate)); DTSSP (3,3'-dithiobis(sulfosuccinimidyl propionate)); DST (disuccinimidyl tartrate); BSOCOES (bis(2-(succinimidooxycarbonyloxy)-ethyl)sulfone); EGS (ethylene glycol bis(succinimidyl succinate)); DMA (dimethyl adipimidate); DMP (dimethyl pimelimidate); DMS (dimethyl suberimidate); DTBP (Wang and Richard's Reagent); BM(PEG)2 (1,8-bismaleimido-diethyleneglycol); BM(PEG)3 (1,11-bismaleimido-triethyleneglycol); BMB (1,4-bismaleimidobutane); DTME (dithiobismaleimidoethane); BMH (bismaleimidohexane); BMOE (bismaleimidoethane); TMEA (tris(2-maleimidoethyl)amine); SPDP (succinimidyl 3-(2-pyridyldithio)propionate); SMCC (Succinimidyl trans-4-(maleimidylmethyl) cyclohexane-1-Carboxylate); SIA (succinimidyl iodoacetate); SBAP (succinimidyl 3-(bromoacetamido)propionate); STAB (succinimidyl (4-iodoacetyl)-aminobenzoate); Sulfo-SIAB (sulfosuccinimidyl (4-iodoacetyl) aminobenzoate); AMAS (N-α-maleimidoacet-oxysuccinimide ester); BMPS (N-β-maleimidopropyl-oxysuccinimide ester); GMBS (N-γ-maleimidobutyryl-oxysuccinimide ester); Sulfo-GMBS (N-γ-maleimidobutyryl-oxysulfosuccinimide ester); MBS (m-maleimidobenzoyl-N-hydroxysuccinimide ester); Sulfo-MBS (m-maleimidobenzoyl-N-hydroxysulfosuccinimide ester); SMCC (succinimidyl 4-(N-maleimidomethyl)cyclohexane-1-carboxylate); Sulfo-SMCC (sulfosuccinimidyl 4-(N-maleimidomethyl) cyclohexane-1-carboxylate); EMCS (N-ε-malemidocaproyl-oxysuccinimide ester); Sulfo-EMCS (N-ε-maleimidocaproyl-oxysulfosuccinimide ester); SMPB (succinimidyl 4-(p-maleimidophenyl)butyrate); Sulfo-SMPB (sulfosuccinimidyl 4-(N-maleimidophenyl)-butyrate); SMPH (Succinimidyl 6-((beta-maleimidopropionamido)-hexanoate)); LC-SMCC (succinimidyl 4-(N-maleimidomethyl) cyclohexane-1-carboxy-(6-amidocaproate)); Sulfo-KMUS (N-κ-maleimidoundecanoyl-oxysulfosuccinimide ester); SPDP (succinimidyl 3-(2-pyridyldithio)propionate); LC-SPDP (succinimidyl 6-(3(2-pyridyldithio)propionamido) hexanoate); LC-SPDP (succinimidyl 6-(3(2-pyridyldithio)propionamido)hexanoate); Sulfo-LC-SPDP (sulfosuccinimidyl 6-(3'-(2-pyridyldithio)propionamido)hexanoate); SMPT (4-succinimidyloxycarbonyl-alpha-methyl-α(2-pyridyldithio)toluene); PEG4-SPDP (PEGylated, long-chain SPDP crosslinker); PEG12-SPDP (PEGylated, long-chain SPDP crosslinker); SM(PEG)2 (PEGylated SMCC crosslinker); SM(PEG)4 (PEGylated SMCC crosslinker); SM(PEG)6 (PEGylated, long-chain SMCC crosslinker); SM(PEG)8 (PEGylated, long-chain SMCC crosslinker); SM(PEG)12 (PEGylated, long-chain SMCC crosslinker); SM(PEG)24 (PEGylated, long-chain SMCC crosslinker); BMPH (N-β-maleimidopropionic acid hydrazide); EMCH (N-ε-maleimidocaproic acid hydrazide); MPBH (4-(4-N-maleimidophenyl)butyric acid hydrazide); KMUH (N-κ-maleimidoundecanoic acid hydrazide); PDPH (3-(2-pyridyldithio)-propionyl hydrazide); ATFB-SE (4-Azido-2,3,5,6-Tetrafluorobenzoic Acid, Succinimidyl Ester); ANB-NOS (N-5-azido-2-nitrobenzoyloxysuccinimide); SDA (NHS-Diazirine) (succinimidyl 4,4'-azipentanoate); LC-SDA (NHS-LC-Diazirine) (succinimidyl 6-(4,4'-azipentanamido)hexanoate); SDAD (NHS-SS-Diazirine) (succinimidyl 2-((4,4'-azipentanamido)ethyl)-1,3'-dithiopropionate); Sulfo-SDA (Sulfo-NHS-Diazirine) (sulfosuccinimidyl 4,4'-azipentanoate); Sulfo-LC-SDA (Sulfo-NHS-LC-Diazirine) (sulfosuccinimidyl 6-(4,4'-azipentanamido)hexanoate); Sulfo-SDAD (Sulfo-NHS-SS-Diazirine) (sulfosuccinimidyl 2-((4,4'-azipentanamido)ethyl)-1,3'-dithiopropionate); SPB (succinimidyl-[4-(psoralen-8-yloxy)]-butyrate); Sulfo-SANPAH (sulfosuccinimidyl 6-(4'-azido-2'-nitrophenylamino)hexanoate); DCC (dicyclohexylcarbodiimide); EDC (1-ethyl-3-(3-dimethylaminopropyl)carbodiimide hydrochloride); glutaraldehyde, formaldehyde, paraformaldehyde, succinaldehyde, glyoxal, methylene glycol, and any combination thereof. In some embodiments, glutaraldehyde acetals, 1,4-pyran, and 2-alkoxy-3,4-dihydro-2H-pyrans, such as 2-ethoxy-3,4-dihydro-2H-pyran may be used in place of glutaraldehyde.

In some embodiments, the crosslinking agents may have spacer arms between the reactive end groups. The length of the spacer arm may determine the type of the crosslinks on the natural feather. For example, crosslinking agents with shorter spacer arm may result in forming crosslinks between two reactive groups that are present on adjacent barbs or hooklets of the same feather. Traditional crosslinking agents have spacer arms that contain hydrocarbon chains or polyethylene glycol (PEG) chains. In addition, the molecular composition of a crosslinking agent's spacer arm may affect solubility. Hydrocarbon chains are not water soluble and typically require an organic solvent such as DMSO or DMF for suspension.

In some embodiments, the crosslinking agents for crosslinking arrow fletchings may be of formula $X_1$—R—$X_2$ wherein is $X_1$ and $X_2$ are independently, imide, imidoester, succinimide, succinimidylsuccinate, sulfosuccinimide, oxysuccinimide, oxysulfosuccinimide, sulfosuccinimidylsuccinate, succinimidyloxyl, succinimidyloxycarbonyl, succinimidyloxycarbonyloxyl, maleimide, halogen, pyridylthio, maleimidopropionamido, hydrazide, azidofluorobenzoic acid, fluorobenzoic acid, 5-azido-2nitrobenzoyl Y-succinimide, diazirine, nitrophenylazide, cyclohexylimide. In some embodiments, R is substituted or unsubstituted alkylene, substituted or unsubstituted alkenylene, substituted or unsubstituted alkynylene, substituted or unsubstituted arylene, substituted or unsubstituted cyclic alkylene, substituted or unsubstituted cyclic alkenylene, substituted or unsubstituted cyclic alkynylene, and substituted or unsubstituted polyethylene glycols. Substituent groups may be, but not limited to, thiol, nitro, amido, ester, oxy, sulfones, oxycarbonyl groups.

In some embodiments, the crosslinking agents for crosslinking arrow fletchings may be photoreactive crosslinking agents, such as UV-crosslinking agents. Photoreactive agents are chemically inert compounds that become reactive when exposed to ultraviolet or visible light. Photoreactive groups that may be incorporated in the crosslinking agent include aryl azides, azido-methyl-coumarins, benzophenones, anthraquinones, certain diazo compounds, diazirines, and psoralen derivatives.

In some embodiments, the crosslinking agents for crosslinking arrow fletchings may be silicone crosslinking agents of the formula:

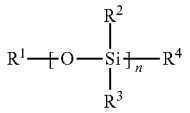

wherein, each $R^1$ to $R^4$, is independently, alkyl, alkenyl, alkynyl, aryl, cycloalkyl, substituted alkyl, substituted alkenyl, substituted alkynyl, substituted aryl, substituted cycloalkyl, and n is an integer from 1 to 20.

In some embodiments, the natural feather for arrow fletchings may be contacted with one or more crosslinking agents by methods, such as dipping, or soaking the natural feather in a solution of crosslinking agent(s), coating or applying a solution of crosslinking agent(s) to the natural feather, spraying a solution of crosslinking agent(s) on the natural feather, and the like.

In some embodiments, the natural feather for arrow fletchings may be contacted with vapors of crosslinking agent(s), preferably in a closed chamber or a reaction vessel. In some embodiments, the natural feather may be incubated in a closed chamber saturated with vapors of crosslinking agent(s).

The natural feather for arrow fletchings may be contacted with one or more crosslinking agents for about 2 minutes to 20 hours, about 2 minutes to 15 hours, about 2 minutes to 10 hours, about 2 minutes to 5 hours, about 2 minutes to 2 hours, about 2 minutes to 1 hour, about 2 minutes to 45 minutes, about 2 minutes to 30 minutes, about 2 minutes to 15 minutes, about 2 minutes to 10 minutes, or about 2 minutes to 5 minutes. Specific examples include about 2 minutes, about 5 minutes, about 10 minutes, about 15 minutes, about 30 minutes, about 45 minutes, about 60 minutes, about 2 hours, about 5 hours, about 10 hours, about 15 hours, about 20 hours, and ranges between any two of these values.

The duration of the time period for contacting may depend on the concentration of the crosslinking agents used. In some embodiments, the one or more crosslinking agents are used in a concentration sufficient to form a crosslink within hooklets, hooks, barbs or barbules of the same feather. The concentration of the crosslinking agent solution used in the methods disclosed herein may be from about 1% to about 100%, about 1% to about 90%, about 1% to about 80%, about 1% to about 70%, about 1% to about 60%, about 1% to about 50%, about 1% to about 40%, about 1% to about 30%, about 1% to about 20%, about 1% to about 10%, about 1% to about 5%, or about 1% to about 2%. The percentages disclosed herein may be weight-by-volume (w/v) percentages for solid crosslinking agents. For liquid crosslinking agents, it may be volume-by-volume (v/v) percentages.

Some non-limiting embodiments of the method described herein include-exposing the natural feather to vapors of 36% formaldehyde solution in a closed chamber; exposing the natural feather to vapors of 18% formaldehyde solution in a closed chamber; exposing the natural feather to vapors of 10% formaldehyde solution in a closed chamber; exposing the natural feather to vapors of 50% gluteraldehyde solution in a closed chamber; exposing the natural feather to vapors of 25% gluteraldehyde solution in a closed chamber; exposing the natural feather to vapors of 10% gluteraldehyde solution in a closed chamber; spraying a 10% formaldehyde solution on the natural feather; spraying a 10% formaldehyde solution on the natural feather; spraying a 50% gluteraldehyde solution on the natural feather; spraying a 25% gluteraldehyde solution on the natural feather; spraying a 10% gluteraldehyde solution on the natural feather; spraying a 4% paraformaldehyde solution on the natural feather; coating a 10% formaldehyde solution on the natural feather; and coating a 10% disuccinimidyl suberate solution on the natural feather.

In some embodiments, chemicals such as methanol, urea, melamine, organic colloids (e.g., methyl cellulose, graft polymers of vinyl acetate and ethylene glycol formaldehyde polyacetal), water insoluble acetals of polyvinyl alcohol, and other polymeric materials such as low molecular weight vinyl polymers containing acetal, acetate, hydroxyl, and optionally, formal, propional or butyral groups may be added to formaldehyde or glutaraldehyde solution to prevent formation of formaldehyde polymers or glutaraldehyde polymers in the solution, and to increase its availability for crosslinking.

In some embodiments, the natural feather for arrow fletchings may be contacted with crosslinking agents under humid conditions in a closed reaction vessel or a chamber. Presence of moisture may prevent the natural feathers from becoming dry and brittle. The humidity in the chamber may be present from about 2% to about 90%, about 2% to about 70%, about 2% to about 50%, or about 2% to about 20%.

In some embodiments, the natural feather for arrow fletchings may be pretreated or exposed to humidifying conditions before contacting the crosslinking agents. In some embodiments, the natural feather may also be pretreated with moisture, wetting agents, lubricants (petroleum jelly, glycerin, paraffin wax, polypropylene glycol etc.), and the like before contacting the crosslinking agents.

In some embodiments, the natural feather may be contacted with the crosslinking agents in the presence of a buffer, to maintain adequate pH conditions for crosslinking. The buffers that may be used in the methods described herein are, phosphate buffers, acetate buffers, citrate buffers, borate buffers, Tris buffers, HEPES buffers, PIPES buffers, MOPS buffers, carbonate buffers, bicarbonate buffers, or any buffers known in the art. These buffering agents may be used to maintain a pH range suitable for crosslinking agents to react with the functional groups present on the natural feathers. Preferred pH range may be from pH 2 to about pH 10, from pH 2 to about pH 9, from pH 2 to about pH 8, from pH 2 to about pH 7, and ranges between any two of these values.

In some embodiments, the natural feather may be pretreated with buffers before contacting crosslinking agents. For example, a pH buffering agent described herein may be sprayed on the natural feather before contacting them with the crosslinking agents. In a non-limiting embodiment, the natural feather may be pretreated with phosphate buffered saline from 2 minutes to 20 hours before contacting the one or more crosslinking agents. In other embodiments, the crosslinking agents may be dissolved in a buffer solution before they contact the natural feather.

In some embodiments, the natural feather for arrow fletchings are further treated with an antioxidant prior to crosslinking or after crosslinking step. Without wishing to be bound by theory, the antioxidants may prevent oxidation of amino acids present on the keratin fibers of the natural feathers, and further improve the shelf life of the natural feather shuttlecocks. Non-limiting embodiments of antioxidants that may be used to treated natural feather shuttlecocks are diethylhexyl syringylidene maionate, Vitamin E, diisopropyl vanillidene maionate, tetrahydrocurcumenoids, tocopherol, carotenoids, and anthocyanidins. In some embodiments, non-volatile antioxidants may be used. Examples of such antioxidants include n-propyl 3,4,5-trihydroxybenzoate, 1,2-dihydroxy-4-tert-butylbenzene, 2-isopropyl-5-methylphenol, 3-tert-butyl-4-hydroxyanisole (BHA), butylated hydroxytoluene (BHT), hydroquinone monomethyl ether, 4-isopropoxyphenol, and 4-(1-methylpropyl)phenol. In one embodiment, the volatile antioxidant is a phenol functional antioxidant.

The modified natural feather fletchings disclosed herein can be assembled on any arrow shaft, such as carbon fiber shaft, wooden shaft, fiber reinforced polymer shaft, aluminum shaft, carbon-aluminum shaft, and the like. In some embodiments, the natural feather fletchings may be treated after assembly on an arrow.

In some embodiments, following the treatment of natural feather treated with crosslinkers, the reaction may be quenched or terminated with chemicals such as glycine. In other embodiments, the treated feathers may be placed in a chamber with air flow or suction, at room temperature, to remove unreacted crosslinking agents.

Also disclosed herein is an apparatus for modifying natural feather for arrow fletchings. The apparatus may include a closed reaction vessel having an inlet configured to allow a crosslinking agent with reactivity to amine, sulfhydryl, carbonyl, aldehyde, hydroxyl, or carboxyl groups present on the feathers to enter the reaction vessel, and an outlet configured to allow the crosslinking agent to exit the reaction vessel. The apparatus may further include mechanical elements for introducing, holding and removal of feathers. The apparatus may also include a thermoelectric couple, a pressure gauge, a temperature controller, a cooling system, a mechanical stirrer, or any combination thereof. The reaction vessel of apparatus may be configured to maintain humidity during the reaction process.

Also disclosed herein are kits for modifying the natural feathers for arrow fletchings. The kit includes one or more crosslinking agents in a solution form, and a container for spraying or applying the one or more crosslinking agents. The kit may further include an ultraviolet light source, one or more humidity chambers, and instructions for treating the natural feathers with crosslinking agents.

EXAMPLES

Example 1: A Natural Feather Shuttlecock Treated with Formaldehyde Vapors

Figure 1:
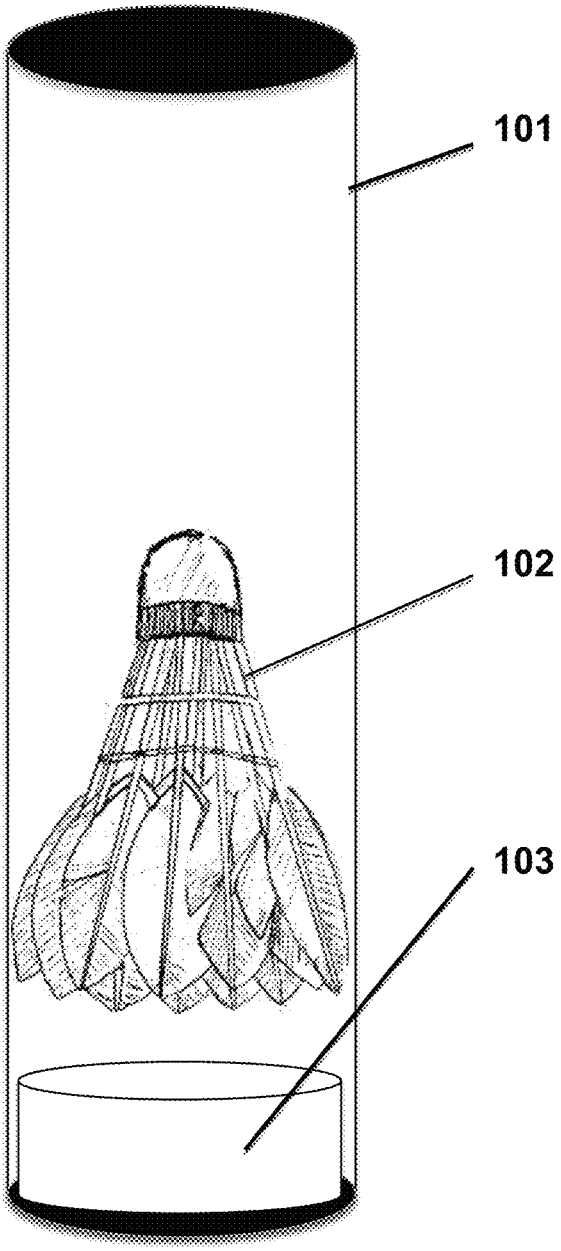
FIG. 1 depicts an illustrative method for reacting natural feather shuttlecocks with the vapors of a crosslinking agent according to an embodiment.

FIG. 1 depicts a method of treating a natural feather shuttlecock with vapors of formaldehyde. A natural feather shuttlecock 102 was placed in a closed treatment chamber 101 in an inverted position. The treatment chamber contained about 10 ml of 36% formaldehyde solution 103 at the bottom. This arrangement allowed formaldehyde vapors to form in the chamber by evaporation. Treatment was carried out for several time intervals such as 2 minutes, 5 minutes, 10 minutes, 15 minutes, 30 minutes, one hour, two hours, 4 hours, 6 hours, 8 hours, and 20 hours. After treatment, the shuttlecock is kept at room temperature for several hours to remove unreacted formaldehyde. The weight of the treated shuttlecock was measured. The change in weight following treatment was observed to be negligible and well within the range of weights allowed by the badminton world federation, which is 4.74 grams to 5.50 grams.

Several shuttlecocks treated in this manner were tested for structural stability, durability and flight characteristics. Treatment for just 15 minutes prolonged the durability of shuttlecocks by a factor of 4 to 6 when compared to untreated shuttlecocks. Similar vapor treatment of natural feather shuttlecocks by 18% formaldehyde yielded similar test results.

Example 2: A Natural Feather Shuttlecock Treated with Formaldehyde Solution

A series of natural feather shuttlecocks were treated with formaldehyde solution as follows. The top portion of the shuttlecock consisting the vanes and top portions of the shafts were kept immersed in 36% formaldehyde solution inside a narrow treatment chamber. This arrangement allowed formaldehyde solution to act directly on the feathers' vanes and top portions of shafts and also the vapors to form in the chamber by evaporation. Treatment was carried out for several time intervals such as 2 minutes, 5 minutes, 10 minutes, 15 minutes, 30 minutes, one hour, 2 hours, 4 hours, 6 hours, 8 hours, and 20 hours. After treatment, the shuttlecock is kept at room temperature for several hours to remove unreacted formaldehyde. Several shuttlecocks treated in this manner were taken out at the end of the treatment and tested for structural stability, durability and flight characteristics. Treatment for just one hour prolonged the useful life of shuttlecocks by a factor of 2 to 3 when compared to untreated shuttlecocks.

Similar treatment of another set of shuttlecocks with 18% formaldehyde, formed by diluting 36% stock formaldehyde with water, yielded similar test results.

Example 3: A Natural Feather Shuttlecock Treated with Glutaraldehyde Vapors

A natural feather shuttlecock is placed in a closed chamber and exposed to glutaraldehyde vapors emanating from 25% glutaraldehyde solution. Treatment was carried out for several time intervals such as 2 minutes, 5 minutes, 10 minutes, 15 minutes, 30 minutes, one hour, two hours, 4 hours, 6 hours, 8 hours, and 20 hours. After treatment, the shuttlecock was kept at room temperature for several hours to remove unreacted glutaraldehyde. Several shuttlecocks treated in this manner were taken out at the end of the treatment and tested for structural stability, durability and flight characteristics. Treatment for just one hour increased the useful life of shuttlecocks by a factor of 2 to 3 when compared to untreated shuttlecocks.

Example 4: A Natural Feather Shuttlecock Reinforced with an Additional Thread A natural feather shuttlecock is treated as in Example 1. A polymeric thread 401 is stitched tightly across the individual shafts of the feathers of the shuttlecock at the skirt region (FIG. 4A). Several shuttlecocks modified in this manner are tested for structural stability, durability and flight characteristics. Reinforcements increased the useful life of shuttlecocks by a factor of 8 to 10 when compared to untreated shuttlecocks without reinforcements.

Example 5: A Natural Feather Shuttlecock Reinforced with Polymeric Filament

A natural feather shuttlecock is treated as in Example 1 and reinforcements in the form of a thin lightweight polymeric filament 402 is applied along the shaft (FIG. 4B). Several shuttlecocks treated in this manner are tested for structural stability, durability and flight characteristics. Reinforcements increased the useful life of shuttlecocks by a factor of 8 to 10 when compared to untreated shuttlecocks without reinforcements.

Example 6: Methods to Measure the Structural Integrity of Treated Natural Feather Shuttlecocks A treated natural feather shuttlecock of Example 1 is mounted on a racket-based shuttle launcher. A high-speed camera that can capture 1000 frames per second is placed to record any deformation happening to the skirt portion of the shuttlecock immediately following impact. Recordings are made from 0-0.01 seconds of impact of the racket. The treated shuttlecock is tested ten times to check predictability and reproducibility of behavior. Similar measurements are carried out separately with untreated shuttlecocks. The measurements will show that treated shuttlecocks display reduced deformation of shuttlecock skirts when compared to untreated shuttlecocks.

Example 7: Methods to Measure the Structural Integrity of Treated Natural Feather Shuttlecocks A treated natural feather shuttlecock with reinforcements as shown in Example 4 is mounted on a racket-based shuttle launcher. A high-speed camera that can capture 1000 frames per second is placed to record any deformation happening to the skirt portion of the shuttlecock immediately following impact. Recordings are made from 0-0.01 seconds of impact of the racket. The treated shuttlecock is tested ten times to check predictability and reproducibility of behavior. Similar measurements are carried out separately with untreated shuttlecocks. The measurements will show that treated shuttlecocks modified with reinforcements to the shafts will display reduced deformation of skirts when compared to shuttlecocks without reinforcements.

Example 8: A Natural Feather Fletching Treated with Glutaraldehyde Vapors

Arrow fletchings from natural feathers are placed in a closed chamber and exposed to glutaraldehyde vapors emanating from 25% glutaraldehyde solution. Treatment is carried out for several time intervals such as 2 minutes, 5 minutes, 10 minutes, 15 minutes, 30 minutes, one hour, two hours, 4 hours, 6 hours, 8 hours, and 20 hours. After treatment, the fletchings are kept at room temperature for several hours to remove unreacted glutaraldehyde. Several fletchings treated in this manner are taken out at the end of the treatment and assembled on an arrow. The arrow is tested for structural stability, durability and flight characteristics.

Example 9: Methods to Measure the Structural Integrity of Treated Natural Feather Fletchings Arrow fletchings from natural feathers are placed in a closed chamber and exposed to glutaraldehyde vapors emanating from 25% glutaraldehyde solution. Treatment is carried out for several time intervals such as 2 minutes, 5 minutes, 10 minutes, 15 minutes, 30 minutes, one hour, two hours, 4 hours, 6 hours, 8 hours, and 20 hours. After treatment, the fletchings are kept at room temperature for several hours to remove unreacted glutaraldehyde. Several fletchings treated in this manner are taken out at the end of the treatment and assembled on an arrow. The arrow is tested for structural stability by measuring impact deformation upon hitting a target using a high-speed camera that can capture 1000 frames per second. Untreated fletchings show more deformation when compared to treated fletchings.

While preferred embodiments have been shown and described, various modifications and substitutions may be made thereto without departing from the spirit and scope of the method and device. Accordingly, it is to be understood that the present method and device has been described by way of illustration and not limitation This disclosure is not limited to the particular systems, devices and methods described, as these may vary. The terminology used in the description is for the purpose of describing the particular versions or embodiments only, and is not intended to limit the scope.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A modified natural feather shuttlecock comprising reinforcements along individual feather shaft in the form selected from the group consisting of threads, filaments, patches, injections and combinations thereof applied along the outer side of the shuttlecock, wherein the feather shaft comprises feathers that are crosslinked with one or more crosslinking agents.

2. The modified natural feather shuttlecock of claim 1, wherein the filaments are made of alloys or polymers.

3. The modified natural feather shuttlecock of claim 1, wherein the one or more crosslinking agents are selected from the group consisting of a homobifunctional crosslinking agent, a heterobifunctional crosslinking agent, a trifunctional crosslinking agent, a UV-inducible crosslinking agent, and combinations thereof.

4. The modified natural feather shuttlecock of claim 1, wherein the crosslinking agent is selected from the group consisting of formaldehyde, gluteraldehyde, and a combination thereof.

5. The modified natural feather shuttlecock of claim 1, wherein one or more reactive groups are present on the feathers of the shuttlecock and are crosslinked, wherein the one or more reactive groups are selected from the group consisting of amine, amide, sulfhydryl, carbonyl, aldehyde, hydroxyl, carboxyl, and combinations thereof.

6. The modified natural feather shuttlecock of claim 1, wherein the one or more crosslinking agents are selected from the group consisting of NHS (N-hydroxysuccinimide); sulfo-NHS (N-hydroxysulfosuccinimide); EDC dimethylaminopropyl]); carbodiimide hydrochloride; SMCC (succinimidyl 4-(N-maleimidomethyl)cyclohexane-1-carboxylate); sulfo-SMCC; DSS (disuccinimidyl suberate); DSG (disuccinimidyl glutarate); DFDNB (1,5-difluoro-2,4-dinitrobenzene); BS3 (bis(sulfosuccinimidyl)suberate); TSAT (tris-(succinimidyl)aminotriacetate); BS(PEG)5 (PEGylated bis(sulfosuccinimidyl)suberate); BS(PEG)9 (PEGylated bis (sulfosuccinimidyl)suberate); DSP(dithiobis(succinimidyl propionate)); DTSSP (3,3'-dithiobis(sulfosuccinimidyl propionate)); DST (disuccinimidyl tartrate); BSOCOES (bis(2-(succinimidooxycarbonyloxy)ethyl)sulfone); EGS (ethylene glycol bis(succinimidyl succinate)); DMA (dimethyl adipimidate); DMP (dimethyl pimelimidate); DMS (dimethyl suberimidate); DTBP (Wang and Richard's Reagent); BM(PEG)2 (1,8-bismaleimido-diethyleneglycol); BM(PEG)3 (1,11-bismaleimido-triethyleneglycol); BMB (1,4-bismaleimidobutane); DTME (dithiobismaleimidoethane); BMH (bismaleimidohexane); BMOE (bismaleimidoethane); TMEA (tris(2-maleimidoethyl)amine); SPDP (succinimidyl 3-(2-pyridyldithio)propionate); SMCC (Succinimidyl trans-4-(maleimidylmethyl)cyclohexane-1-Carboxylate); SIA (succinimidyl iodoacetate); SBAP (succinimidyl 3-(bromoacetamido)propionate); STAB (succinimidyl (4-iodoacetyl)aminobenzoate); Sulfo-SIAB (sulfosuccinimidyl (4-iodoacetyl) aminobenzoate); AMAS (N-α-maleimidoacet-oxysuccinimide ester); BMPS (N-β-maleimidopropyl-oxysuccinimide ester); GMBS (N-γ-maleimidobutyryl-oxysuccinimide ester); Sulfo-GMBS (N-γ-maleimidobutyryl-oxysulfosuccinimide ester); MBS (m-maleimidobenzoyl-N-hydroxysuccinimide ester); Sulfo-MBS (m-maleimidobenzoyl-N-hydroxysulfosuccinimide ester); SMCC (succinimidyl 4-(N-maleimidomethyl)cyclohexane-1-carboxylate); Sulfo-SMCC (sulfosuccinimidyl 4-(N-maleimidomethyl)cyclohexane-1-carboxylate); EMCS (N-ε-malemidocaproyl-oxysuccinimide ester); Sulfo-EMCS (N-ε-maleimidocaproyl-oxysulfosuccinimide ester); SMPB (succinimidyl 4-(p-maleimidophenyl)butyrate); Sulfo-SMPB (sulfosuccinimidyl 4-(N-maleimidophenyl)butyrate); SMPH (Succinimidyl 6-((beta-maleimidopropionamido)hexanoate)); LC-SMCC (succinimidyl 4-(N-maleimidomethyl) cyclohexane-1-carboxy-(6-amidocaproate)); Sulfo-KMUS (N-κ-maleimidoundecanoyl-oxysulfosuccinimide ester); SPDP (succinimidyl 3-(2-pyridyldithio)propionate); LC-SPDP (succinimidyl 6-(3(2-pyridyldithio)propionamido) hexanoate); LC-SPDP (succinimidyl 6-(3(2-pyridyldithio)propionamido)hexanoate); Sulfo-LC-SPDP (sulfosuccinimidyl 6-(3'-(2-pyridyldithio)propionamido)hexanoate); SMPT (4-succinimidyloxycarbonyl-alpha-methyl-α(2-pyridyldithio)toluene); PEG4-SPDP (PEGylated, long-chain SPDP crosslinker); PEG12-SPDP (PEGylated, long-chain SPDP crosslinker); SM(PEG)2 (PEGylated SMCC crosslinker); SM(PEG)4 (PEGylated SMCC crosslinker); SM(PEG)6 (PEGylated, long-chain SMCC crosslinker); SM(PEG)8 (PEGylated, long-chain SMCC crosslinker); SM(PEG)12 (PEGylated, long-chain SMCC crosslinker); SM(PEG)24 (PEGylated, long-chain SMCC crosslinker) BMPH (N-β-maleimidopropionic acid hydrazide); EMCH (N-ε-maleimidocaproic acid hydrazide); MPBH (4-(4-N-maleimidophenyl)butyric acid hydrazide); KMUH (N-κ-maleimidoundecanoic acid hydrazide); PDPH (3-(2-pyridyldithio)propionyl hydrazide); ATFB-SE (4-Azido-2,3,5,6-Tetrafluorobenzoic Acid, Succinimidyl Ester); ANB-NOS (N-5-azido-2-nitrobenzoyloxysuccinimide); SDA (NHS-Diazirine) (succinimidyl 4,4'-azipentanoate); LC-SDA (NHS-LC-Diazirine) (succinimidyl 6-(4,4'-azipentanamido)hexanoate); SDAD (NETS-SS-Diazirine) (succinimidyl 2-((4,4'-azipentanamido)ethyl)-1,3'-dithiopropionate); Sulfo-SDA (Sulfo-NHS-Diazirine) (sulfosuccinimidyl 4,4'-azipentanoate); Sulfo-LC-SDA (Sulfo-NHS-LC-Diazirine) (sulfosuccinimidyl 6-(4,4'-azipentanamido)hexanoate); Sulfo-SDAD (Sulfo-NHS-SS-Diazirine) (sulfosuccinimidyl 2-((4,4'-azipentanamido)ethyl)-1,3'-dithiopropionate); SPB (succinimidyl-[4-(psoralen-8-yloxy)]-butyrate); Sulfo-SANPAH (sulfosuccinimidyl 6-(4'-azido-2'-nitrophenylamino)hexanoate); DCC (dicyclohexylcarbodiimide); EDC (1-ethyl-3-(3-dimethylaminopropyl)carbodiimide hydrochloride); gluteraldehyde; formaldehyde; and any combination thereof.

7. A modified natural feather shuttlecock comprising reinforcements along individual feather shaft in the form selected from the group consisting of threads, filaments, patches, injections and combinations thereof applied along the inner side of the shuttlecock, wherein the feather shaft comprises feathers that are crosslinked with one or more crosslinking agents.

8. The modified natural feather shuttlecock of claim 7, wherein the filaments are made of alloys or polymers.

9. The modified natural feather shuttlecock of claim 7, wherein the one or more crosslinking agents are selected from the group consisting of a homobifunctional crosslinking agent, a heterobifunctional crosslinking agent, a trifunctional crosslinking agent, a UV-inducible crosslinking agent, and combinations thereof.

10. The modified natural feather shuttlecock of claim 7, wherein the crosslinking agent is selected from the group consisting of formaldehyde, gluteraldehyde, and a combination thereof.

11. The modified natural feather shuttlecock of claim 7, wherein one or more reactive groups are present on the feathers of the shuttlecock and are crosslinked, wherein the one or more reactive groups are selected from the group consisting of amine, amide, sulfhydryl, carbonyl, aldehyde, hydroxyl, carboxyl, and combinations thereof.

12. The modified natural feather shuttlecock of claim 7, wherein the one or more crosslinking agents are selected from the group consisting of NHS (N-hydroxysuccinimide); sulfo-NHS (N-hydroxysulfosuccinimide); EDC dimethylaminopropyl]); carbodiimide hydrochloride; SMCC (succinimidyl 4-(N-maleimidomethyl)cyclohexane-1-carboxylate); sulfo-SMCC; DSS (disuccinimidyl suberate); DSG (disuccinimidyl glutarate); DFDNB (1,5-difluoro-2,4-dinitrobenzene); BS3 (bis(sulfosuccinimidyl)suberate); TSAT (tris-(succinimidyl)aminotriacetate); BS(PEG)5 (PEGylated bis(sulfosuccinimidyl)suberate); BS(PEG)9 (PEGylated bis (sulfosuccinimidyl)suberate); DSP(dithiobis(succinimidyl propionate)); DTSSP (3,3'-dithiobis(sulfosuccinimidyl propionate)); DST (disuccinimidyl tartrate); BSOCOES (bis(2-(succinimidooxycarbonyloxy)ethyl)sulfone); EGS (ethylene glycol bis(succinimidyl succinate)); DMA (dimethyl adipimidate); DMP (dimethyl pimelimidate); DMS (dimethyl suberimidate); DTBP (Wang and Richard's Reagent); BM(PEG)2 (1,8-bismaleimido-diethyleneglycol); BM(PEG)3 (1,11-bismaleimido-triethyleneglycol); BMB (1,4-bismaleimidobutane); DTME (dithiobismaleimidoethane); BMH (bismaleimidohexane); BMOE (bismaleimidoethane); TMEA (tris(2-maleimidoethyl)amine); SPDP (succinimidyl 3-(2-pyridyldithio)propionate); SMCC (Succinimidyl trans-4-(maleimidylmethyl)cyclohexane-1-Carboxylate); SIA (succinimidyl iodoacetate); SBAP (succinimidyl 3-(bromoacetamido)propionate); STAB (succinimidyl (4-iodoacetyl)aminobenzoate); Sulfo-SIAB (sulfosuccinimidyl (4-iodoacetyl) aminobenzoate); AMAS (N-α-maleimidoacet-oxysuccinimide ester); BMPS (N-β-maleimidopropyl-oxysuccinimide ester); GMBS (N-γ-maleimidobutyryl-oxysuccinimide ester); Sulfo-GMBS (N-γ-maleimidobutyryl-oxysulfosuccinimide ester); MBS (m-maleimidobenzoyl-N-hydroxysuccinimide ester); Sulfo-MBS (m-maleimidobenzoyl-N-hydroxysulfosuccinimide ester); SMCC (succinimidyl 4-(N-maleimidomethyl)cyclohexane-1-carboxylate); Sulfo-SMCC (sulfosuccinimidyl 4-(N-maleimidomethyl)cyclohexane-1-carboxylate); EMCS (N-!-malemidocaproyl-oxysuccinimide ester); Sulfo-EMCS (N-ε-maleimidocaproyl-oxysulfosuccinimide ester); SMPB (succinimidyl 4-(p-maleimidophenyl)butyrate); Sulfo-SMPB (sulfosuccinimidyl 4-(N-maleimidophenyl)butyrate); SMPH (Succinimidyl 6-((beta-maleimidopropionamido)hexanoate)); LC-SMCC (succinimidyl 4-(N-maleimidomethyl) cyclohexane-1-carboxy-(6-amidocaproate)); Sulfo-KMUS (N-κ-maleimidoundecanoyl-oxysulfosuccinimide ester); SPDP (succinimidyl 3-(2-pyridyldithio)propionate); LC-SPDP (succinimidyl 6-(3(2-pyridyldithio)propionamido) hexanoate); LC-SPDP (succinimidyl 6-(3(2-pyridyldithio)propionamido)hexanoate); Sulfo-LC-SPDP (sulfosuccinimidyl 6-(3'-(2-pyridyldithio)propionamido)hexanoate); SMPT (4-succinimidyloxycarbonyl-alpha-methyl-α(2-pyridyldithio)toluene); PEG4-SPDP (PEGylated, long-chain SPDP crosslinker); PEG12-SPDP (PEGylated, long-chain SPDP crosslinker); SM(PEG)2 (PEGylated SMCC crosslinker); SM(PEG)4 (PEGylated SMCC crosslinker); SM(PEG)6 (PEGylated, long-chain SMCC crosslinker); SM(PEG)8 (PEGylated, long-chain SMCC crosslinker); SM(PEG)12 (PEGylated, long-chain SMCC crosslinker); SM(PEG)24 (PEGylated, long-chain SMCC crosslinker) BMPH (N-β-maleimidopropionic acid hydrazide); EMCH (N-ε-maleimidocaproic acid hydrazide); MPBH (4-(4-N-maleimidophenyl)butyric acid hydrazide); KMUH (N-κ-maleimidoundecanoic acid hydrazide); PDPH (3-(2-pyridyldithio)propionyl hydrazide); ATFB-SE (4-Azido-2,3,5,6-Tetrafluorobenzoic Acid, Succinimidyl Ester); ANB-NOS (N-5-azido-2-nitrobenzoyloxysuccinimide); SDA (NHS-Diazirine) (succinimidyl 4,4'-azipentanoate); LC-SDA (NHS-LC-Diazirine) (succinimidyl 6-(4,4'-azipentanamido)hexanoate); SDAD (NHS-SS-Diazirine) (succinimidyl 2-((4,4'-azipentanamido)ethyl)-1,3'-dithiopropionate); Sulfo-SDA (Sulfo-NHS-Diazirine) (sulfosuccinimidyl 4,4'-azipentanoate); Sulfo-LC-SDA (Sulfo-NHS-LC-Diazirine) (sulfosuccinimidyl 6-(4,4'-azipentanamido)hexanoate); Sulfo-SDAD (Sulfo-NHS-SS-Diazirine) (sulfosuccinimidyl 2-((4,4'-azipentanamido)ethyl)-1,3'-dithiopropionate); SPB (succinimidyl-[4-(psoralen-8-yloxy)]-butyrate); Sulfo-SANPAH (sulfosuccinimidyl 6-(4'-azido-2'-nitrophenylamino)hexanoate); DCC (dicyclohexylcarbodiimide); EDC (1-ethyl-3-(3-dimethylaminopropyl)carbodiimide hydrochloride); gluteraldehyde; formaldehyde; and any combination thereof.

* * * * *